US006217293B1

(12) United States Patent
Murase et al.

(10) Patent No.: US 6,217,293 B1
(45) Date of Patent: Apr. 17, 2001

(54) VARIABLE DISPLACEMENT COMPRESSOR

(75) Inventors: Masakazu Murase; Yoshinobu Ishigaki; Kazuaki Iwama; Takuya Okuno, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/358,585

(22) Filed: Jul. 21, 1999

(30) Foreign Application Priority Data

Jul. 27, 1998 (JP) ..... 10-211395

(51) Int. Cl.[7] ..... F04B 1/26
(52) U.S. Cl. ..... 417/222.2
(58) Field of Search ..... 417/222.2

(56) References Cited

U.S. PATENT DOCUMENTS

| | | | | |
|---|---|---|---|---|
| 4,867,648 | | 9/1989 | Murayama | 417/222 |
| 5,242,274 | | 9/1993 | Inoue | 417/222.2 |
| 5,318,410 | * | 6/1994 | Kawamura et al. | 417/222.2 |
| 5,865,604 | * | 2/1999 | Kawaguchi et al. | 417/222.2 |
| 5,971,716 | * | 10/1999 | Ota et al. | 417/222.2 |
| 5,975,859 | * | 11/1999 | Kawaguchi et al. | 417/222.2 |
| 6,010,312 | * | 1/2000 | Suitou et al. | 417/222.2 |

FOREIGN PATENT DOCUMENTS 7-253080 10/1995 (JP) .

OTHER PUBLICATIONS

German Search Report dated Oct. 23, 2000 (and translation thereof).

* cited by examiner

*Primary Examiner*—Timothy S. Thorpe
*Assistant Examiner*—Ehud Gartenberg
(74) *Attorney, Agent, or Firm*—Morgan & Finnegan, L.L.P.

(57) ABSTRACT

A variable displacement compressor includes a swash plate, which is rotatably supported on a drive shaft in a crank chamber. The crank chamber is connected to a discharge chamber through a pressurizing passage. An electromagnetic control valve is located in the pressurizing passage. When the control valve opens the pressurizing passage, pressure in the crank chamber increases and inclination of the swash plate decreases. When the control valve closes the pressurizing passage, the pressure in the crank chamber decreases and inclination of the swash plate increases. A fixed restrictor is located in the pressurizing passage. When the control valve suddenly opens the pressurizing passage, the fixed restrictor limits the flow rate of gas in the pressurizing passage so that the pressure in the crank chamber gradually increases. Accordingly, the inclination of the swash plate gradually decreases, thus reducing vibration and noise.

13 Claims, 4 Drawing Sheets

VARIABLE DISPLACEMENT COMPRESSOR

BACKGROUND OF THE INVENTION

The present invention relates to a variable displacement compressor for vehicle air-conditioning system. More specifically, the present invention relates to a variable displacement compressor having a drive plate for reciprocating pistons, the inclination angle of which is varied.

FIGS. 3 and 4 show a conventional variable displacement compressor. A drive shaft 102 is rotatably supported in a housing 101. The housing 101 includes cylinder bores 101*a,* a crank chamber 103, a suction chamber 104, and a discharge chamber 105. A piston 106 is accommodated in each cylinder bore 101*a* to reciprocate. A rotor 107 is fixed to the drive shaft 102 in the crank chamber 103. A drive plate, or a swash plate 108, is accommodated in the crank chamber 103. The drive shaft 102 penetrates the swash plate 108. A hinge mechanism 109 is located between the rotor 107 and the swash plate 108. The hinge mechanism 109 rotates the swash plate 108 together with the drive shaft 102 and the rotor 107 and permits the swash plate 108 to incline with respect to the drive shaft 102. The pistons 106 are coupled to the swash plate 108.

The drive shaft 102 is connected to an external drive source, or an engine 110, of the vehicle without a clutch mechanism such as an electromagnetic clutch. The drive shaft 102 is constantly driven while the engine 110 is running. The swash plate converts the rotation of the drive shaft 102 into reciprocation of each piston 106. Each piston 106 draws refrigerant gas from the suction chamber 104 to the corresponding cylinder bore 101*a* and compresses the gas. Then, the refrigerant gas is discharged from the cylinder bore 101*a* to the discharge chamber 105.

A pressurizing passage 111 connects the crank chamber 103 to the discharge chamber 105. A bleeding passage 112 connects the crank chamber 103 to the suction chamber 104. A displacement control valve 113 is located in the pressurizing passage 111. The control valve 113 is an electromagnetic valve and moves a valve body 113b by exciting and de-exciting a solenoid 113*a*. This opens and closes the pressurizing passage 111. When the solenoid 113*a* is excited, the control valve 113 closes the pressurizing passage 111. When the solenoid 113*a* is de-excited, the control valve 113 opens the pressurizing passage 111.

As shown in FIG. 3, when the pressurizing passage 111 is closed, the refrigerant gas does not flow from the discharge chamber 105 to the crank chamber 103. Accordingly, the pressure in the crank chamber 103 decreases and the inclination angle of the swash plate 108 increases. This increases the piston stroke and displacement of the compressor. As shown in FIG. 4, when the pressuring passage 111 is opened, the refrigerant gas flows from the discharge chamber 105 to the crank chamber 103. Accordingly, pressure in the crank chamber 103 increases and the inclination angle of the swash plate 108 decreases. This decreases the piston stroke and displacement of the compressor.

A suction passage 114 is formed in the housing 101 and connects an external refrigerant circuit to the suction chamber 104. A shutter 115 engages the rear end of the drive shaft 102 and slides along the axis of the drive shaft 102. The shutter 115 moves with the swash plate 108 and selectively opens and closes the suction passage 114. As shown in FIG. 3, when the swash plate 108 is positioned at its maximum inclination angle by the excitation of solenoid 113*a,* the shutter 115 opens the suction passage 114. Accordingly, the refrigerant gas flows from the external refrigerant circuit to the suction chamber 104. As shown in FIG. 4, when the swash plate 108 is positioned at its minimum inclination angle by the demagnetization of the solenoid 113a, the shutter 115 closes the suction 114. Accordingly, refrigerant gas does not flow from the external refrigerant circuit to the suction chamber 104. This stops the circulation of refrigerant gas between the external refrigerant circuit and the compressor.

The control valve 113 includes an electromagnetic valve and suddenly opens the pressurizing passage 111 when the solenoid 113*a* is demagnetized. Accordingly, high-pressure refrigerant gas of the discharge chamber 105 suddenly flows into the crank chamber. This suddenly increases pressure in the crank chamber 103 and reduces the inclination angle of the swash plate 108. This increases friction on the engaging parts of the hinge mechanism 109, the swash plate 108 and the drive shaft 102, which produces vibration and noise.

SUMMARY OF THE INVENTION

An objective of the present invention is to control the sudden change of pressure in the crank chamber and slows the change of inclination angle of the drive plate in a variable displacement compressor.

To achieve the above objective, the present invention provides a variable displacement compressor that varies the displacement in accordance with the inclination angle of a drive plate located in a crank chamber. The compressor is structured as follows. A piston is connected to the drive plate and is reciprocated by movement of the drive plate. An adjusting mechanism for adjusting the pressure in the crank chamber includes a control passage connected to the crank chamber for permitting passage of a fluid and a control valve located in the control passage for selectively opening and closing the control passage. The inclination of the drive plate is varied in accordance with pressure in the crank chamber and the piston stroke varies in accordance with the drive plate inclination to vary the displacement. A fixed restrictor is located in the control passage, to limit the flow rate of the fluid in the control passage.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings.

DETAILED DESCRIPTION OF THE PREFERRED EMBODIMENTS

A variable displacement compressor according to one embodiment of the present invention will now be described.

Figure 1:
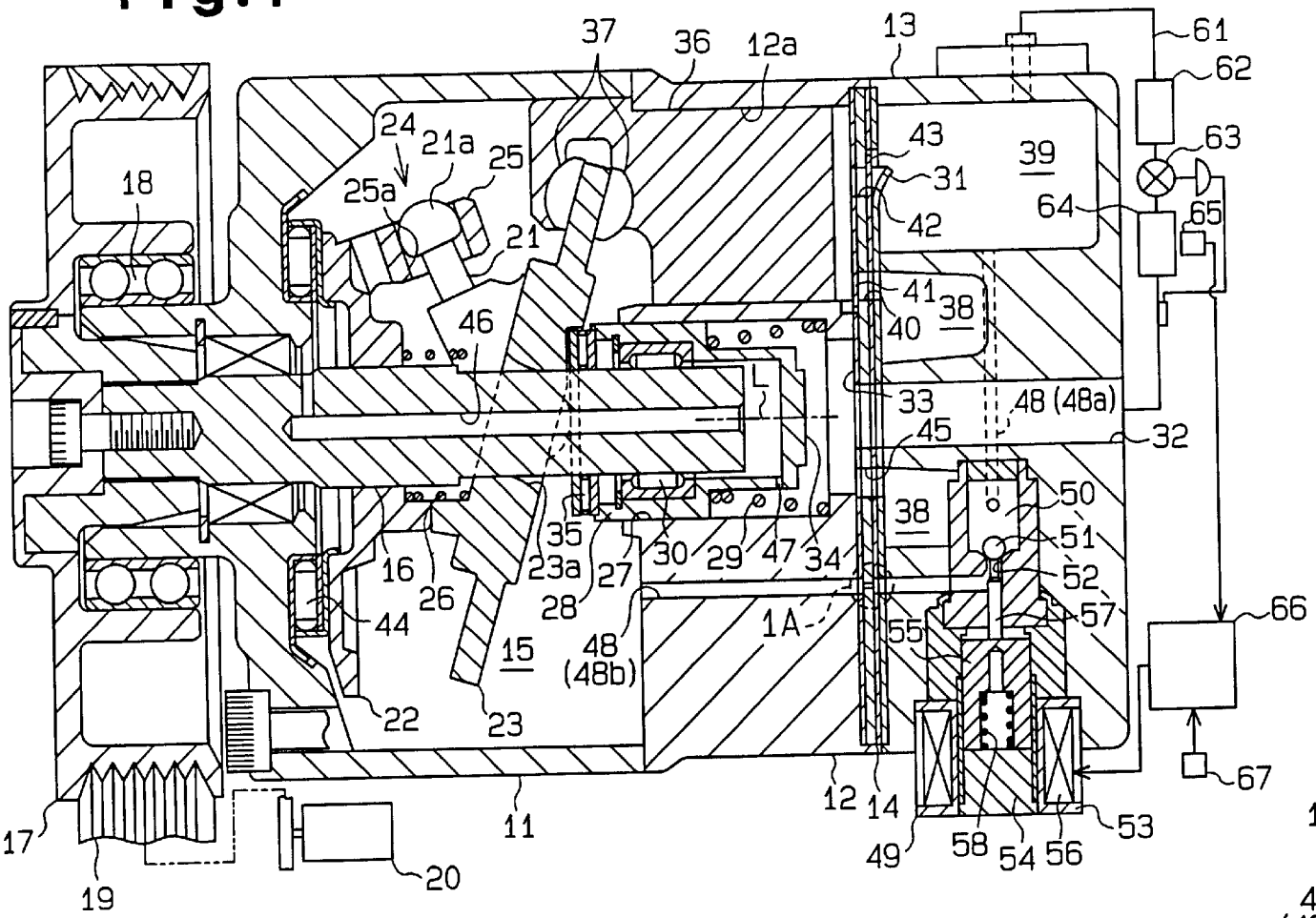
FIG. 1 is a cross sectional view of a variable displacement compressor according to one embodiment of the present invention.
Figure 1A:
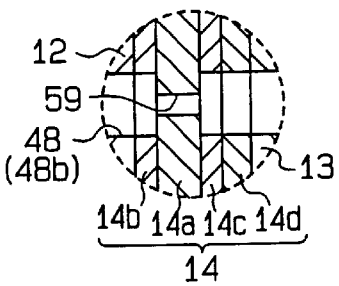
FIG. 1A is an enlarged view of the encircled area 1A of FIG. 1.
Figure 2:
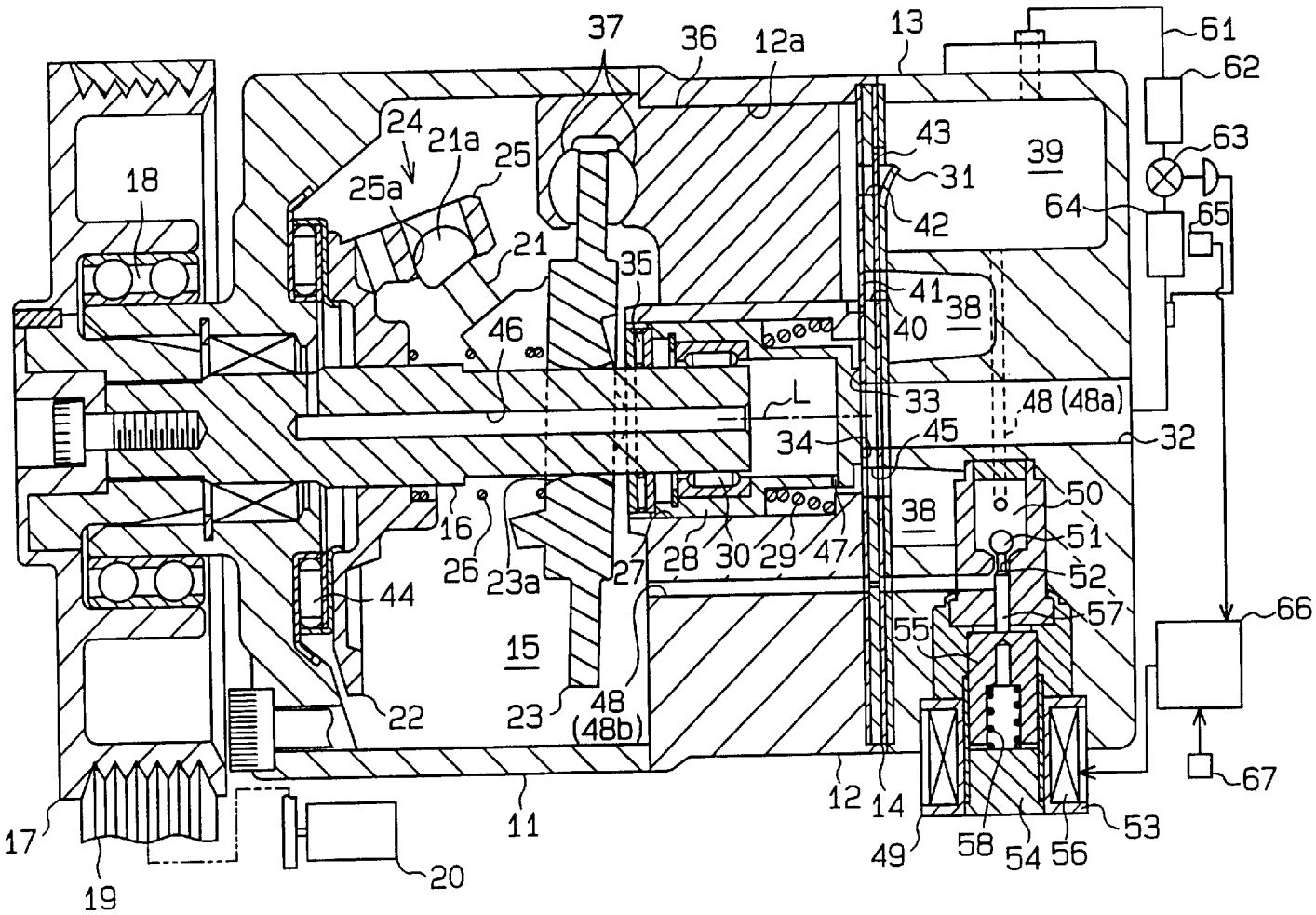
FIG. 2 is a cross sectional view of the variable displacement compressor of FIG. 1 when the swash plate is minimally inclined.
Figure 3:
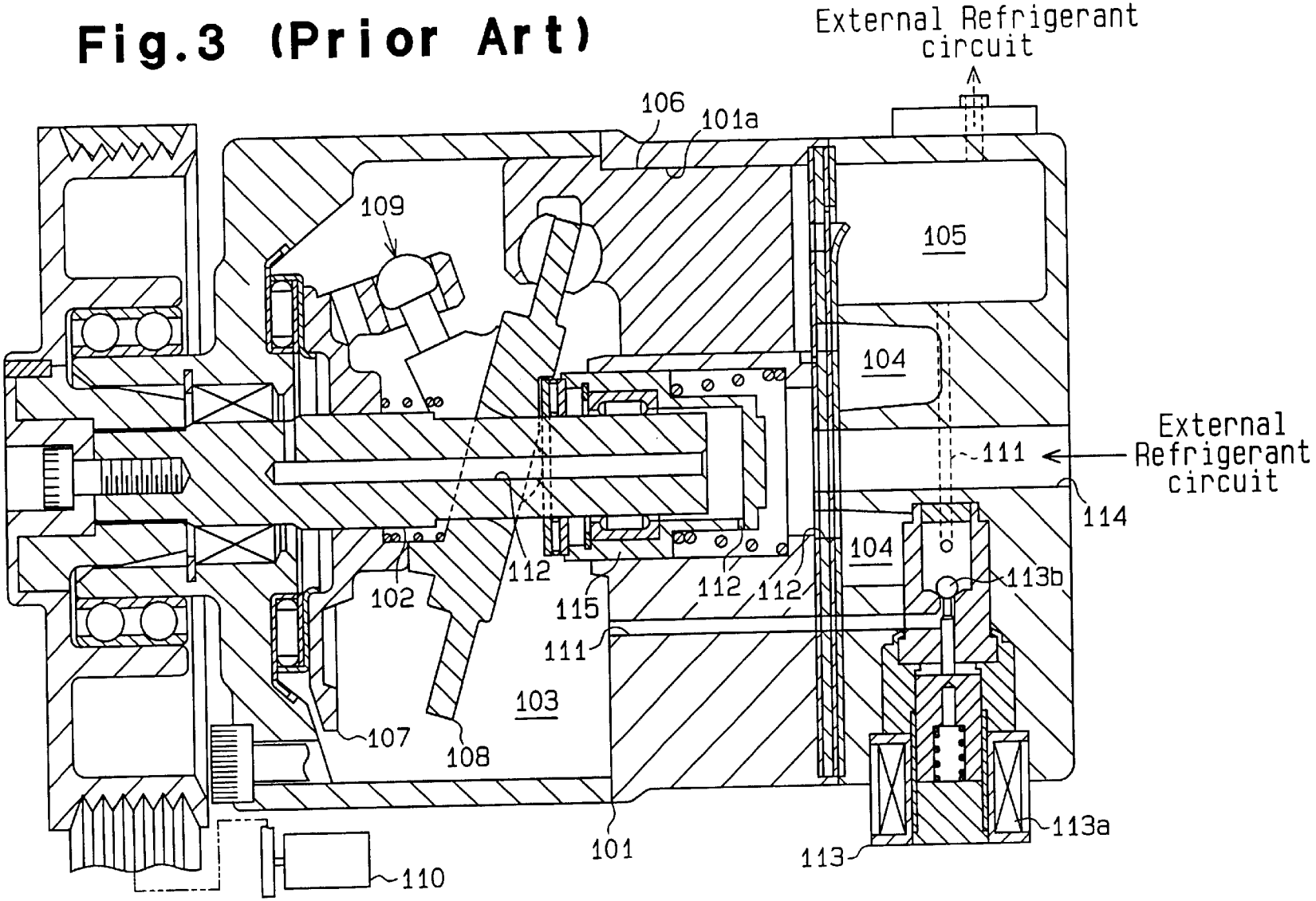
Fig.3 (Prior Art)
FIG. 3 is a cross sectional view of a prior art variable displacement compressor.
Figure 4:
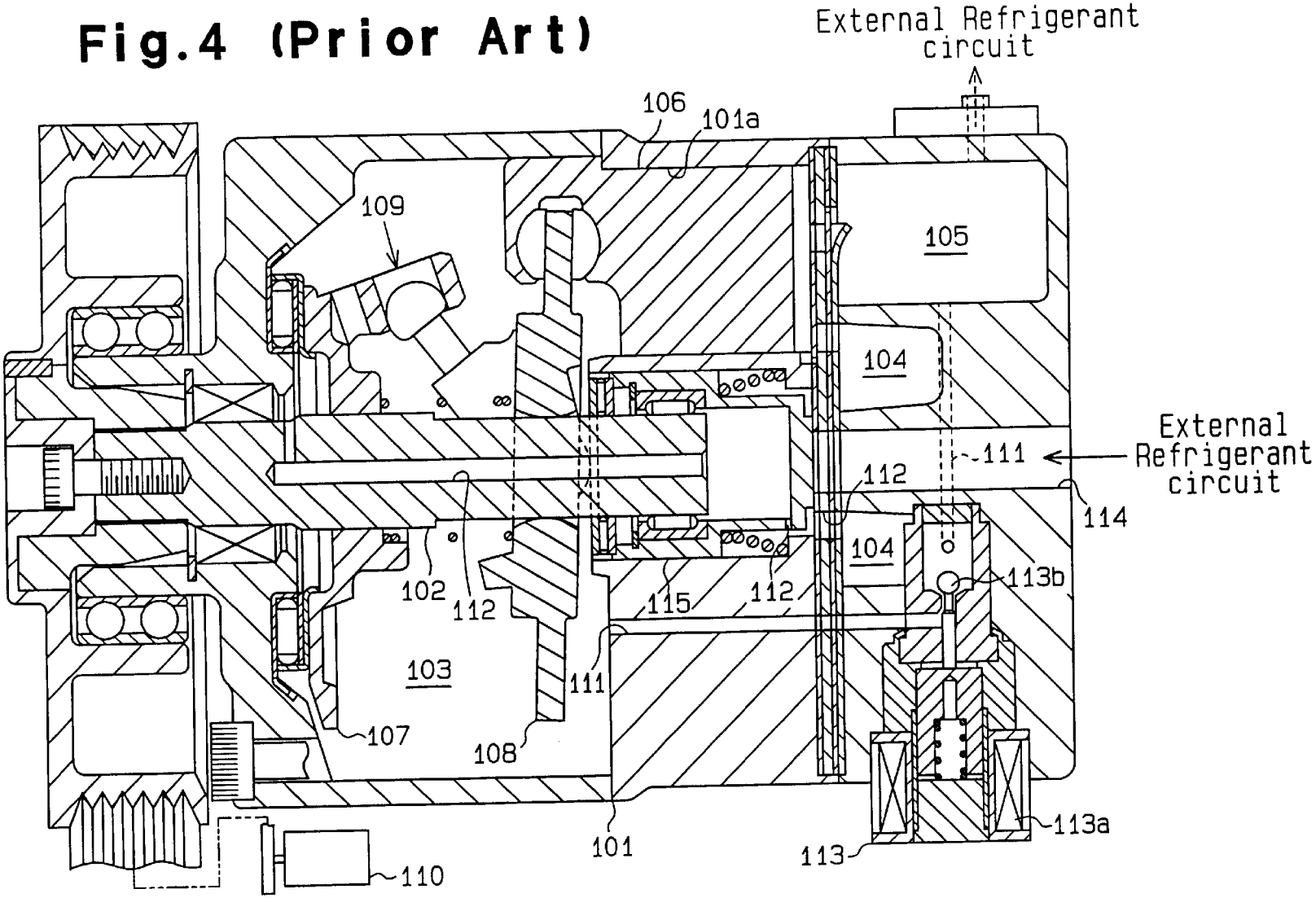
Fig.4 (Prior Art)
FIG. 4 is a cross sectional view of the variable displacement compressor of FIG. 3 when the swash plate is minimally inclined.

As shown in FIGS. 1 and 2, a front housing 11 is joined and secured to the front end of a cylinder block 12. A rear housing 13 is joined and secured to the rear end of the cylinder block 12 through a valve plate 14. As shown in FIG. 1A, the valve plate 14 includes a main plate 14*a*, a first sub-plate 14*b*, a second sub-plate 14*c*, and a retainer plate 14*d*. The first sub-plate 14*b* is located on the front side of the main plate 14*a*. The second sub-plate 14*c* is located on the rear side of the main plate 14*a*. The retainer plate 14*d* is located on the rear side of the second sub-plate 14*c*.

A crank chamber 15 is defined between the front housing 11 and the cylinder block 12. A drive shaft 16 passes through the crank chamber 15 and is rotatably supported by the front housing 11 and the cylinder block 12.

A pulley 17 is rotatably supported at the front end of the front housing 11 through an annular bearing 18 and is secured to the drive shaft 16. The pulley 17 is connected to an outer drive source, or an engine 20, without a clutch mechanism such as an electromagnetic clutch. Accordingly, the engine 20 rotates the drive shaft 16 through a belt 19 and the pulley 17.

A rotor 22 is secured to the drive shaft 16 in the crank chamber 15. A drive plate, or a swash plate 23, is inclinably and slidably supported by the drive shaft 16. The swash plate 23 slides along the axis L of the drive shaft 16. The drive shaft 16 penetrates a through hole 23*a* in the center of the swash plate 23. A hinge mechanism 24 is located between the rotor 22 and the swash plate 23.

The hinge mechanism 24 will now be described. A pair of guide pins 21 (only one shown) are attached to the front surface of the swash plate 23. Each of the guide pins 21 includes a spherical head 21*a*. A support arm 25 projects from the rear surface of the rotor 22. The support arm 25 includes a pair of guide holes 25*a*. Each spherical head 21*a* of the guide pins 21 is received in the corresponding guide hole 25*a*.

The engagement of the guide pin 21 with the support arm 25 causes the swash plate 23 to rotate integrally with the drive shaft 16 and the rotor 22. The engagement also permits the swash plate 16 to move along the axis L of the drive shaft 16 and to incline with respect to the drive shaft 16. As the swash plate 23 moves toward the cylinder block 12, the inclination angle of the swash plate 23 decreases. A spring 26 is located between the rotor 22 and the swash plate 23. The spring 26 urges the swash plate 23 rearward, or toward its minimum inclination. As shown in FIG. 1, when the swash plate 23 abuts against the rotor 22, the swash plate 23 is positioned at its maximum inclination.

A shutter bore 27 is formed in the center of the cylinder block 12. A cylindrical shutter 28, which has one closed end, is slidably accommodated in the shutter bore 27. An opener spring 29 is located between a step on the inner surface of the shutter bore 27 and the shutter 28 and urges the shutter 28 toward the swash plate 23.

The rear end of the drive shaft 16 is received in the shutter 28. A radial bearing 15 is fixed to the inner surface of the shutter 28 and rotatably supports the drive shaft 16. The radial bearing 30, together with the shutter 28, slides axially on the drive shaft 16.

A suction passage 32 is formed in the center of the rear housing 13 and the valve plate 14. The inner end of the suction passage 32 is open to the shutter bore 27. A positioning surface 33 is formed on the valve plate 14 around the opening of the suction passage 32. The shutter 28 has a shutting surface 34, which can contact the positioning surface 33. When the shutting surface 34 contacts the positioning surface 33, the suction passage 32 is disconnected from the shutter bore 27.

A thrust bearing 35 is located between the swash plate 23 and the shutter 28 and is slidably supported on the drive shaft 16. The thrust bearing 35 is held between the swash plate 23 and the shutter 28 by the force of the opener spring 29.

The swash plate 23 moves rearward (rightward in FIG. 1) as its inclination angle decreases. In this movement, the swash plate 23 pushes the shutter 28 through the thrust bearing 35. Accordingly, the shutter 28 moves toward the positioning surface 33 against the force of the opener spring 29. When the shutting surface 34 of the shutter 28 contacts the positioning surface 33, the swash plate 23 is positioned at its minimum inclination angle. The minimum inclination angle of the swash plate 23 is slightly greater than zero degrees. The inclination angle of the swash plate 23 is measured with respect to a plane perpendicular to the axis L of the drive shaft 16.

Cylinder bores 12*a* (only one shown) are formed in the cylinder block 12. A single-headed piston 36 is accommodated in each of the cylinder bores 12*a*. Each piston 36 is coupled to the periphery of the swash plate 23 through a pair of shoes 37. Each piston 36 reciprocates in the corresponding cylinder bore 12*a* as the swash plate 23 rotates.

A suction pressure zone, or a suction chamber 38, is formed in the rear housing 13. A discharge pressure zone, or a discharge chamber 39, is also formed in the rear housing 13. A suction port 40 and a discharge port 42 are formed in the main plate 14*a* to correspond to each cylinder bore 12*a*. A suction valve 41 is formed in the first sub-plate 14*b* to correspond to each suction port 40. A discharge valve 43 is formed in the second sub-plate 14*c* to correspond to each discharge port 42. A retainer 31 is formed in the retainer plate 14*d* to correspond to each discharge valve 43.

When the piston 36 moves from the top dead center position to the bottom dead center position, refrigerant gas in the suction chamber is drawn to the cylinder bore 12*a* through the suction port and the suction valve 41. When the piston 36 moves from the bottom dead center position to the top dead center position, refrigerant in the cylinder bore 12*a* is compressed to a predetermined pressure and is discharged to the discharge chamber 39 through the discharge port 42 and the discharge valve 43. The retainer 31 determines the maximum opening position of the discharge valve 43.

A thrust bearing 44 is located between the rotor 22 and the inner wall of the front housing 11. A thrust bearing 44 receives a compression reaction force applied to the pistons 36 through the swash plate 23, hinge mechanism 24, and the rotor 22.

The suction chamber 38 is connected to the shutter bore 27 through a passage 45, which is formed in the valve plate 14. When the shutter 28 contacts the positioning surface 33, the passage 45 is disconnected from the suction passage 32. An axial passage 46 is formed in the drive shaft 16 to connect the crank chamber 15 with the inside of the shutter 28. A pressure release passage 47 is formed in the wall of the shutter 28. The inside of the shutter 28 is connected to the internal space of the shutter bore 27 through the release passage 47. The axial passage 46, the release passage 47, and the passage 45 form a bleeding passage. The bleeding passage connects the crank chamber 15 to the suction chamber 38. The release passage 47 functions as a fixed restrictor and restricts the flow of refrigerant from the crank chamber 15 to the suction chamber 38.

A control passage, or a pressurizing passage 48, connects the discharge chamber 39 to the crank chamber 15. A displacement control valve 49, which is an electromagnetic valve, is installed in the rear housing 13. The control valve 49 is located in the pressurizing passage 48 and selectively opens and closes the pressurizing passage 48.

The control valve 49 will now be described in detail. The control valve 49 includes a valve chamber 50, which is located in the pressurizing passage 48, and a valve hole 52, which is connected to the valve chamber 50. A spherical valve body 51 located in the valve chamber 50 to face the valve hole 52. The valve chamber 50 and the valve hole 52 form part of the pressurizing passage 48.

A solenoid 53 includes a fixed metal core 54, a movable metal core 55, and a coil 56. A rod 57 transmits the movement of the movable core 55 to the valve body 51. An opener spring 58 urges the valve body 51 to open the valve hole 52 through the movable core 55 and the rod 57. The coil 56 is arranged around the fixed core 54 and the movable core 55.

When the solenoid 53 is excited, that is, when electric current is supplied to the coil 53, an electromagnetic attraction force is generated between the cores 54, 55. This moves the movable core 55 toward the fixed core 54 against the force of the opener spring 58. As a result, the valve body 51 closes the valve hole 52 as shown in FIG. 1. When the solenoid is de-excited, that is, when the supply of electric current to the coil 56 is stopped, the electromagnetic attraction force between the cores 54, 55 disappears. Accordingly, the force of the opener spring 58 causes the movable core 55 to move away from the fixed core 54, and as shown in FIG. 2, the valve body 51 opens the valve hole 52.

The pressurizing passage 48 includes an upstream passage 48*a*, which is located between the discharge chamber 39 and the valve chamber 50 of the control valve 49, and a downstream passage 48*b*, which is located between the valve chamber 50 and the crank chamber 15. The upstream passage 48*a* is formed in the rear housing 13. The downstream passage 48*b* is formed in the rear housing 13, the valve plate 14, and the cylinder block 12.

A fixed restrictor 59 is located in the pressurizing passage 48. The restrictor 59 is formed by reducing the cross-sectional area of a small part of the pressurizing passage 48. The restrictor 59 is preferably located in the downstream passage 48*b*. In detail, the restrictor 59 is formed as shown in FIG. 1A. That is, a part of the downstream passage 48*b* that is located in the main plate 14*a* of the valve plate 14 has a smaller diameter than the remainder of the passage.

An external refrigerant circuit 61 connects the suction passage 32 to the discharge chamber 39. The external refrigerant circuit 61 includes a condenser 62, an expansion valve 63, and an evaporator 64.

A temperature sensor 65 is located near the evaporator 64. The temperature sensor 65 detects the temperature of the evaporator 64 and outputs a detection signal to a computer 66. The computer 66 controls the excitation and de-excitation of the solenoid 53 according to the detection signal from the temperature sensor 65. When the detected temperature falls below a predetermined temperature while the air-conditioner switch 67 is on, the computer 66 de-excites the solenoid 53. Frost occurs in the evaporator 64 at temperatures below the predetermined temperature. When the air-conditioner switch 67 is turned off, the computer 66 also de-excites the solenoid 53.

As shown in FIG. 2, when the solenoid 53 is de-excited, the control valve 49 opens the pressurizing passage 48. Accordingly, the high-pressure refrigerant gas of the discharge chamber 39 flows to the crank chamber 15 through the pressurizing passage 48, which increases the pressure in the crank chamber 15. As a result, the swash plate 23 is moved to the minimum inclination and the displacement of the compressor is minimized.

When the swash plate 23 is at the minimum inclination, the shutter 28 contacts the positioning surface 33 and closes the suction passage 32. Accordingly, refrigerant gas cannot flow from the external refrigerant circuit 61 to the suction chamber 38, and circulation of refrigerant gas between the external refrigerant circuit 61 and the compressor is stopped.

Since the minimum inclination angle of the swash plate 23 is not zero degrees, the pistons 36 continue to reciprocate with a very short stroke. Accordingly, a small amount of refrigerant gas continues to be drawn from the suction chamber 38 to the cylinder bores 12*a* and discharged from the cylinder bores 12*a* to the discharge chamber 39. That is, when the inclination angle of the swash plate 23 is minimized, refrigerant gas circulates through the discharge chamber 39, the pressurizing passage 48, the crank chamber 15, the axial passage 46, the release passage 47, the suction chamber 38, and the cylinder bores 12*a*. The lubricant oil contained in the refrigerant gas also circulates and lubricates parts of the compressor.

When the solenoid 53 is excited, the pressurizing passage 48 is closed as shown in FIG. 1. Since refrigerant gas from the crank chamber 15 continuously flows to the suction chamber 38 through the axial passage 46, the release passage 47 and the passage 45, the pressure in the crank chamber 15 is lowered gradually. As a result, the swash plate 23 moves from the minimum inclination to the maximum inclination angle, and the displacement of the compressor is maximized. When the swash plate 23 moves away from the minimum inclination position, the shutter 28 opens the suction passage 32. Accordingly, refrigerant gas flows from the external refrigerant circuit 61 to the suction chamber 38. This permits the circulation of refrigerant between the external refrigerant circuit 61 and the compressor.

The fixed restrictor 59 is located in the pressurizing passage 48. When the pressurizing passage 48 is suddenly opened by the de-excitation of the solenoid 53, the restrictor 59 limits the flow rate of refrigerant from the discharge chamber 39 to the crank chamber 15. Accordingly, pressure in the crank chamber 15 gradually increases and the inclination angle of the swash plate 23 gradually decreases. Therefore, strong friction between the guide pin 21 and the support arm 25 and between the swash plate 23 and the drive shaft 16 is prevented. This reduces vibration and noise.

Under the normal operation of the compressor, the compression load applied to the pistons 36 is received in a stable manner by the thrust bearing 44 through the swash plate 23, the hinge mechanism 24 and the rotor 22. However, it has been confirmed by the inventors' experiments that, if the inclination angle of the swash plate 23 is suddenly reduced, the compression load from the pistons 36 is applied in an unstable manner to the swash plate 23 and is not properly received by the thrust bearing 44. This causes the swash plate 23 to move in an unstable manner and produces excessive force on the joint between the guide pin 21 and the support arm 25, which generates chatter. The restrictor 59 prevents this problem.

The fixed restrictor 59 is located in the downstream passage 48*b* of the pressurizing passage 48, between the control valve 49 and the crank chamber 15. The restrictor 59 reduces the flow rate of refrigerant that flows from the control valve 49 to the crank chamber 15. When the flow rate of refrigerant is reduced, atomized lubricant oil in the refrigerant gas is more easily separated from the gas and adhered to the inner wall of the suction passage 48. The lubricant oil adhered to the inner wall is then moved to the crank chamber 15 by the flow of the refrigerant gas. The lubricant oil in the crank chamber 15, which has been separated from the refrigerant gas, remains in the crank chamber 15 for a relatively long time. Therefore, the sliding surfaces located in the crank chamber 15 are adequately lubricated.

If the fixed restrictor 59 were located in the upstream passage 48*a,* lubricant oil separated from the refrigerant gas by the restrictor 59 would tend to remain in the control valve 49 and not easily reach the crank chamber 15.

The fixed restrictor 59 is simply formed by reducing the diameter of an opening in a section of the pressurizing passage 48.

The fixed restrictor 59 is formed in the valve plate 14, and more specifically, in the main plate 14*a*. This facilitates forming the restrictor 59, compared to forming a restrictor in the cylinder block 12. If a restrictor were formed in the cylinder block 12, small-diameter drilling would be necessary, which is troublesome and expensive. In contrast, in the present embodiment, the restrictor 59, which may have an arbitrary diameter, can be easily and precisely formed in the main plate 14a by punching before assembling the main plate 14*a*.

The present invention can further be embodied as follows.

The fixed restrictor 59 may be formed in other part of the valve plate 14, that is, the first sub-plate 14*b,* the second sub-plate 14*c* or the retainer plate 14*d*.

The fixed restrictor 59 may be located in other parts of the downstream passage 48*b*.

The fixed restrictor 59 may be formed in the upstream passage 48*a*.

The fixed restrictor 59 may be formed in the control valve 49.

A pin having a diameter smaller than the pressurizing passage 48 may be arranged inside the pressurizing passage 48 to function as a fixed restrictor.

Opposite to the embodiments of FIGS. 1 and 2, the solenoid of the control valve may be excited to open the pressurizing passage 48 and de-excited to close the passage 48. In this case, the excitation of the solenoid suddenly opens the pressurizing passage 48. However, the fixed restrictor 59 prevents a sudden increase of pressure in the crank chamber 15.

The control valve 49 and the fixed restrictor 59 may be located in the bleeding passage that connects the crank chamber 15 to the suction chamber 38. In this case, the control valve 49 controls the flow of refrigerant gas from the crank chamber 15 to the suction chamber 38, thus controlling the displacement of the compressor. Though the excitation or de-excitation of the solenoid 53 suddenly opens the bleeding passage, the fixed restrictor 59 prevents a sudden decrease of pressure in the crank chamber 15, thus preventing a sudden increase of the inclination angle of the swash plate 23.

Other types of control valves may be used instead of an electromagnetic valve. For example, a control valve having a pressure sensitive member such as bellows may be used. In this case, the pressure sensitive member moves a valve body in accordance with the pressure (suction pressure) of refrigerant gas drawn to the compressor. The movement of the valve body adjusts the opening size of a valve hole. In addition to the pressure sensitive member, the control valve may include a solenoid that variably urges the valve body. In this case, the forces applied to the valve body from the pressure sensitive member and the solenoid determine the opening size of the valve hole.

Therefore, the present examples and embodiments are to be considered as illustrative and not restrictive and the invention is not to be limited to the details given herein, but may be modified within the scope and equivalence of the appended claims.

What is claimed is:

1. A variable displacement compressor that varies the displacement in accordance with the inclination angle of a drive plate located in a crank chamber, the compressor comprising:

a piston connected to the drive plate, wherein the piston is reciprocated by movement of the drive plate;

an adjusting mechanism for adjusting the pressure in the crank chamber, the mechanism including a control passage connected to the crank chamber for permitting passage of a fluid and a control valve located in the control passage for selectively opening and closing the control passage, wherein the inclination of the drive plate is varied in accordance with pressure in the crank chamber and the piston stroke varies in accordance with the drive plate inclination to vary the displacement;

a cylinder block having a cylinder bore for accommodating the piston;

a housing member joined to the cylinder block, the housing member including a suction chamber and a discharge chamber; and a valve plate located between the cylinder block and the housing member, wherein the piston draws fluid from the suction chamber to the cylinder bore through the valve plate and discharges the fluid to the discharge chamber through the valve plate, the valve plate defining a through hole, which forms part of the control passage and functions as a fixed restrictor to limit the flow rate of the fluid in the control passage.

2. The compressor according to claim 1 further including a pressurized zone, which is filled with fluid pressurized by the piston, wherein the control passage connects the pressurized zone to the crank chamber to supply fluid from the pressurized zone to the crank chamber.

3. The compressor according to claim 2, wherein the fixed restrictor is located between the control valve and the crank chamber.

4. The compressor according to claim 1, wherein the fixed restrictor is formed by reducing the cross sectional area of the control passage at one location.

5. The compressor according to claim 1, wherein the through hole has a smaller cross sectional area than the remainder of the control passage.

6. The compressor according to claim 1, wherein the housing member is a first housing member joined to one end of the cylinder block, and a second housing member is joined to the other end of the cylinder block to form the crank chamber, wherein the control passage extends through the first housing member, the valve plate and the cylinder block to connect the discharge chamber to the crank chamber.

7. The compressor according to claim 6, wherein the control valve is attached to the first housing member and is located between the discharge chamber and the fixed restrictor.

8. A variable displacement compressor comprising:

a housing, wherein the housing includes:

a cylinder bore;

a crank chamber;

a suction chamber; and a discharge chamber;

a piston accommodated in the cylinder bore;

a drive shaft, which is rotatably supported in the housing and which passes through the crank chamber;

a drive plate, which converts rotation of the drive shaft into reciprocation of the piston, wherein the drive plate is supported on the drive shaft to incline with respect to a plane perpendicular to the axis of the drive shaft in accordance with the pressure in the crank chamber, wherein the drive plate varies the piston stroke in accordance with its inclination angle to vary the displacement of the compressor;

a pressurizing passage, which connects the discharge chamber to the crank chamber to supply gas from the discharge chamber to the crank chamber;

an electromagnetic control valve, which is located in the pressurizing passage to selectively open and close the pressurizing passage; and a fixed restrictor, which is located in the pressurizing passage to limit the flow rate of gas in the pressurizing passage, wherein the control valve is located between the discharge chamber and the fixed restrictor.

9. The compressor according to claim 8, wherein the fixed restrictor is located in the pressurizing passage between the control valve and the crank chamber.

10. The compressor according to claim 8, wherein the housing includes:

a cylinder block, in which the cylinder bore is formed;

a front housing member, which is joined to the front end of the cylinder block to form the crank chamber;

a rear housing member, which is joined to the rear end of the cylinder block and includes the suction chamber and the discharge chamber; and a valve plate, which is located between the cylinder block and the rear housing member, wherein the piston draws gas from the suction chamber to the cylinder bore through the valve plate and discharges gas to the discharge chamber through the valve plate, the valve plate defining a through hole, which forms part of the pressurizing passage and functions as the fixed restrictor.

11. The compressor according to claim 10, wherein the through hole has a smaller cross sectional area than the remainder of the pressurizing passage.

12. The compressor according to claim 10, wherein the control valve is attached to the rear housing member.

13. A variable displacement compressor that varies the displacement in accordance with the inclination angle of a drive plate located in a crank chamber, the compressor comprising:

a piston connected to the drive plate, wherein the piston is reciprocated by movement of the drive plate;

an adjusting mechanism for adjusting the pressure in the crank chamber, the adjusting mechanism including a control passage connected to the crank chamber for permitting passage of a fluid and a control valve located in the control passage for selectively opening and closing the control passage, wherein the inclination of the drive plate is varied in accordance with pressure in the crank chamber and the piston stroke varies in accordance with the drive plate inclination to vary the displacement; and a fixed restrictor, which is located in the control passage, to limit the flow rate of the fluid in the control passage, wherein the fixed restrictor is located between the control valve and the crank chamber, and the fixed restrictor communicates directly with the control valve through the control passage.

* * * * *

UNITED STATES PATENT AND TRADEMARK OFFICE

CERTIFICATE OF CORRECTION

PATENT NO. : 6,217,293 B1
DATED : April 17, 2001
INVENTOR(S) : Masakazu Murase et al.

It is certified that error appears in the above-identified patent and that said Letters Patent is hereby corrected as shown below:

Title page,
Item [54], in the title please change: "VARIABLE DISPLACEMENT COMPRESSOR" to -- VARIABLE DISPLACEMENT COMPRESSOR HAVING A FIXED RESTRICTOR --.

Signed and Sealed this

Twenty-seventh Day of August, 2002

*Attest:*

*Attesting Officer*

JAMES E. ROGAN
*Director of the United States Patent and Trademark Office*